US008668026B2

(12) United States Patent
Aoki

(10) Patent No.: US 8,668,026 B2
(45) Date of Patent: Mar. 11, 2014

(54) POWER TOOL COMPRISING A DYNAMIC VIBRATION REDUCER

(75) Inventor: Yonosuke Aoki, Anjo (JP)

(73) Assignee: Makita Corporation, Anjo-shi (JP)

( * ) Notice: Subject to any disclaimer, the term of this patent is extended or adjusted under 35 U.S.C. 154(b) by 262 days.

(21) Appl. No.: 12/999,208

(22) PCT Filed: Jun. 15, 2009

(86) PCT No.: PCT/JP2009/060879
§ 371 (c)(1),
(2), (4) Date: Mar. 10, 2011

(87) PCT Pub. No.: WO2009/154171
PCT Pub. Date: Dec. 23, 2009

(65) Prior Publication Data

US 2011/0155405 A1 Jun. 30, 2011

(30) Foreign Application Priority Data

Jun. 19, 2008 (JP) ..... 2008-161027

(51) Int. Cl.
*B25D 17/24* (2006.01)

(52) U.S. Cl.
USPC ..... 173/162.1; 173/210; 173/211; 173/212; 173/162.2

(58) Field of Classification Search
USPC ..... 173/210–212, 162.1, 162.2
See application file for complete search history.

(56) References Cited

U.S. PATENT DOCUMENTS

| | | | | |
|---|---|---|---|---|
| 2,875,731 | A * | 3/1959 | Settles et al. | 267/137 |
| 4,478,293 | A * | 10/1984 | Weilenmann et al. | 173/162.2 |
| 7,252,157 | B2 | 8/2007 | Aoki | |
| 7,921,934 | B2 | 4/2011 | Aoki | |
| 2006/0076154 | A1 * | 4/2006 | Aoki | 173/212 |
| 2008/0277128 | A1 | 11/2008 | Satou | |

FOREIGN PATENT DOCUMENTS

| | | | |
|---|---|---|---|
| CN | 1533866 | A | 10/2004 |
| CN | 1946520 | A | 4/2007 |
| CN | 101032814 | A | 9/2007 |
| EP | 1 439 038 | A1 | 7/2004 |
| EP | 1 618 999 | A1 | 1/2006 |
| EP | 1 767 315 | A1 | 3/2007 |
| EP | 1 832 394 | A1 | 9/2007 |
| EP | 2 018 939 | A2 | 1/2009 |
| JP | A-2004-154903 | | 6/2004 |
| JP | A-2007-237301 | | 9/2007 |
| JP | A-2007-237304 | | 9/2007 |

(Continued)

OTHER PUBLICATIONS

Nov. 14, 2011 Extended Search Report issued in European Application No. 09766619.2.

(Continued)

*Primary Examiner* — Michelle Lopez
(74) *Attorney, Agent, or Firm* — Oliff and Berridge, PLC

(57) ABSTRACT

A hammer drill equipped with a main body part; a drive motor; a motion conversion mechanism, and a vibration absorber which are housed in the main body part; and a handgrip which is provided as a continuation of the main body part at a position closer to the rear end side of the tool than the drive motor and used for gripping the tool. The vibration absorber is in a configuration where vibrations of the main body part are suppressed during a machining operation.

12 Claims, 3 Drawing Sheets

(56) References Cited

FOREIGN PATENT DOCUMENTS

| | | | |
|---|---|---|---|
| SU | 550507 | | 3/1977 |
| WO | WO 2006/041139 | A1 | 4/2006 |
| WO | WO 2007/105742 | A1 | 9/2007 |

OTHER PUBLICATIONS

Feb. 8, 2011 International Preliminary Report on Patentability issued in International Application No. PCT/JP2009/060879 (with translation).

International Search Report in International Application No. PCT/JP2009/060879; dated Sep. 29, 2009 (with English-language translation).

Chinese Office Action issued in Chinese Application No. 200980123024.3 dated Sep. 18, 2012 (w/translation).

Apr. 11, 2013 Office Action issued in Chinese Patent Application No. 200980123024.3.

May 30, 2013 Office Action issued in Russian Patent Application No. 2011101689/02(002173) (with English translation).

* cited by examiner

POWER TOOL COMPRISING A DYNAMIC VIBRATION REDUCER

FIELD OF THE INVENTION

The invention relates to a construction of a power tool such as a hammer and a hammer drill linearly driving a tool bit.

BACKGROUND OF THE INVENTION

Japanese laid-open Patent Publication No. 2004-154903 discloses an electric hammer having a vibration reducing mechanism. This known electric hammer has a dynamic vibration reducer as a means for reducing vibration caused in an axial direction of a hammer bit during hammering operation, so that vibration of the hammer during hammering operation can be alleviated or reduced. The dynamic vibration reducer has a weight which can linearly move under a biasing force of a coil spring, and by the movement of the weight in the axial direction of the tool bit, it reduces vibration of the hammer during hammering operation.

In designing a power tool of this type having a dynamic vibration reducer, it is desired to provide a technique which can realize rational placement of the dynamic vibration reducer and a higher vibration reducing effect or higher vibration reducing performance of the dynamic vibration reducer, by further refinement of the construction of the dynamic vibration reducer.

SUMMARY OF THE INVENTION

Accordingly, it is an object of the invention to provide rational placement and improved vibration reducing performance of a dynamic vibration reducer in a power tool having the dynamic vibration reducer.

Above-described object can be achieved by the invention. A representative power tool according to the invention linearly drives a tool bit to perform a predetermined operation on a workpiece and includes at least a tool body, a driving motor, a motion converting mechanism, a dynamic vibration reducer and a handle. The "power tool" here may preferably include power tools, such as a hammer, a hammer drill, a jigsaw and a reciprocating saw, which perform an operation on a workpiece by linear movement of a tool bit. The driving motor is housed in the tool body. The motion converting mechanism is housed in the tool body and disposed in a tool front region forward of the driving motor in the axial direction of the tool bit and converts rotation of the driving motor into linear motion and transmits it to the hammer bit. The "motion converting mechanism" here typically comprises a crank mechanism which includes a crank shaft driven by gear engagement with a motor shaft of the driving motor, a crank arm connected to the crank shaft and a piston connected to the crank arm, and serves to convert rotation of the motor shaft of the driving motor into linear motion of the piston and drive the tool bit. When such a crank mechanism is used as the motion converting mechanism, the crank shaft of the crank mechanism is disposed in the tool front region forward of the motor shaft of the driving motor in the axial direction of the tool bit.

The dynamic vibration reducer is housed in the tool body and includes a dynamic vibration reducer body, a weight and a coil spring. The dynamic vibration reducer body is configured as a part which is disposed in an intermediate region between the motion converting mechanism and the handle and has a housing space. When the crank mechanism as described above is used as the motion converting mechanism, the dynamic vibration reducer body is disposed in a region between the crank shaft of the crank mechanism and the handle in a tool upper region above the motor shaft of the driving motor. The weight is configured as a mass part which is disposed in the housing space of the dynamic vibration reducer body in such a manner as to be linearly movable in the axial direction of the tool bit. The coil spring is configured as an elastic element which extends between at least one of front and rear surfaces of the weight and the dynamic vibration reducer body in the axial direction of the tool bit and elastically supports the weight in the axial direction. The dynamic vibration reducer serves to reduce vibration of the tool body during operation by linear movement of the weight elastically supported by the coil spring in the axial direction of the tool bit. The handle is configured as a handle part designed to be held by a user and connected to the tool body in a tool rear region rearward of the driving motor. Further, the "linear movement of the weight" in this invention is not limited to linear movement in the axial direction of the tool bit, but it is only necessary that the linear movement has at least components in the axial direction of the tool bit.

In the power tool having the above-described construction in which the motion converting mechanism is disposed in the tool front region forward of the driving motor in the axial direction of the tool bit as described above, a free space is likely formed in the intermediate region between the motion converting mechanism and the handle. Therefore, in the power tool according to the invention, the dynamic vibration reducer body is disposed in the intermediate region between the motion converting mechanism and the handle. With this construction, it is not necessary to provide an additional installation space for installing the dynamic vibration reducer body and a space existing within the tool body can be effectively utilized, so that rational placement of the dynamic vibration reducer can be realized.

Further, the dynamic vibration reducer body disposed in the intermediate region between the motion converting mechanism and the handle can be disposed closer to the axis of the tool bit or on an extension of the axis of the tool bit, so that vibration caused by driving the tool bit can be efficiently reduced and the dynamic vibration reducer having a higher vibration reducing effect or higher vibration reducing performance can be realized.

According to a further aspect of the invention, the weight may have a spring receiving part extending in a form of a hollow in the axial direction of the tool bit in at least one of front and rear surface regions of the weight. The spring receiving part receives one end of the coil spring which elastically supports the weight. As for this construction, the spring receiving part may be provided in either one or both of the front and rear surface regions of the weight. With such a construction, by provision of the spring receiving part for receiving one end of the coil spring inside the weight, the length of the dynamic vibration reducer in the axial direction of the tool bit with the coil spring received and mounted in the spring receiving part of the weight can be reduced, so that the size of the dynamic vibration reducer can be reduced in the axial direction of the tool bit.

According to a further aspect of the invention, the spring receiving part may comprise a front surface region spring receiving part and a rear surface region spring receiving part which extend in a form of a hollow in the axial direction of the tool bit in the front and rear surface regions of the weight. The front surface region spring receiving part receives one end of the coil spring that elastically supports the weight from the front of the weight, while the rear surface region spring receiving part receives one end of the coil spring that elastically supports the weight from the rear of the weight. Further, the front and rear surface region spring receiving parts are arranged to overlap each other in its entirety or in part in a direction transverse to the extending direction of the spring receiving parts. Specifically, the front and rear surface region spring receiving parts in its entirety or in part and thus the coil springs in its entirety or in part which are received within the front and rear surface region spring receiving parts are arranged to overlap each other. With such a construction, the length of the weight in the axial direction of the tool bit with the coil springs mounted in the spring receiving parts can be further reduced. Therefore, this construction is effective in further reducing the size of the dynamic vibration reducer in the axial direction and in reducing its weight with a simpler structure. Thus, this construction is particularly effective when the installation space for the dynamic vibration reducer within the tool body is limited in the longitudinal direction of the tool body. Further, the coil springs can be further upsized by the amount of the overlap between the coil springs received in the front surface region spring receiving part and the rear surface region spring receiving part, provided that the length of the dynamic vibration reducer in the longitudinal direction is unchanged. In this case, the dynamic vibration reducer can provide a higher vibration reducing effect with stability by the upsized coil springs.

According to a further aspect of the invention, the weight may be configured as a weight member having a circular section in a direction transverse to the axial direction of the tool bit. Further, a plurality of the front surface region spring receiving parts are provided in the front surface region of the weight member and evenly spaced in the circumferential direction of the weight member, while a plurality of the rear surface region spring receiving parts are provided in the rear surface region of the weight member and evenly spaced in the circumferential direction of the weight member. With such a construction, a plurality of the spring receiving parts are arranged in the front and rear surface regions of the weight member in a balanced manner, so that the center of gravity of the weight member can be easily put in balance. Further, a plurality of the coil springs are disposed in the front and rear surface regions of the weight member in a balanced manner, so that spring forces of the coil springs can be exerted on the front and rear surface of the weight member in a balanced manner.

According to a further aspect of the invention, the motion converting mechanism may include a first space, a striking mechanism and a second space. The first space is configured as a closed space. The striking mechanism serves to strike the tool bit by utilizing air pressure within the first space. The second space may be configured as a space which causes air pressure fluctuations in opposite phase with respect to air pressure fluctuations of the first space. Here, the "air pressure fluctuations of opposite phases" in the first and second spaces typically represents the manner in which the patterns of air pressure fluctuations are generally reversed between the first and second spaces. For example, when the striking mechanism strikes the tool bit, the first space relatively increases in pressure, while the second space relatively decreases in pressure. On the other hand, when the striking movement is completed, the first space relatively decreases in pressure, while the second space relatively increases in pressure. Further, the dynamic vibration reducer has front and rear chambers and a communication path. The front and rear chambers are separated from each other by the weight within the dynamic vibration reducer body and configured as compartments formed at the front and rear of the weight in the axial direction of the tool bit. The communication path serves to provide communication between the rear chamber and the second space. With such a construction, air is introduced from the second space into the rear chamber of the dynamic vibration reducer via the communication path by pressure fluctuations of the second space and thus the weight of the dynamic vibration reducer can be actively driven. In this manner, the dynamic vibration reducer can be caused to perform a vibration reducing function.

According to a further aspect of the invention, the second space may be disposed in the tool front region forward of the dynamic vibration reducer body in the axial direction of the tool bit. Further, the communication path may comprise a communication pipe which is installed to extend from the second space into the rear chamber through the front chamber and then the weight. With such a construction, the communication pipe can be installed in such a manner as to provide communication between the second space and the rear chamber in the shortest distance.

According to a further aspect of the invention, the communication pipe may linearly extend in the axial direction of the tool bit and an outer surface of the communication pipe and an inner surface of the weight fitted onto the communication pipe may be held in sliding contact with each other, so that the communication pipe serves as a guide member for guiding linear movement of the weight in the axial direction. This construction is rational in that linear movement of the weight in the axial direction can be made smoother via the communication pipe and the communication pipe can be further provided with a function as a guide member for guiding linear movement of the weight in the axial direction in addition to the function of introducing air from the second space into the rear chamber of the dynamic vibration reducer.

According to the invention, the vibration reducing effect of a dynamic vibration reducer can be enhanced within a power tool having the dynamic vibration reducer, without upsizing a tool body and with a minimum of weight increase, so that rational placement and improved vibration reducing performance of the dynamic vibration reducer can be realized.

DETAILED DESCRIPTION OF THE REPRESENTATIVE EMBODIMENT OF THE INVENTION

Figure 1:
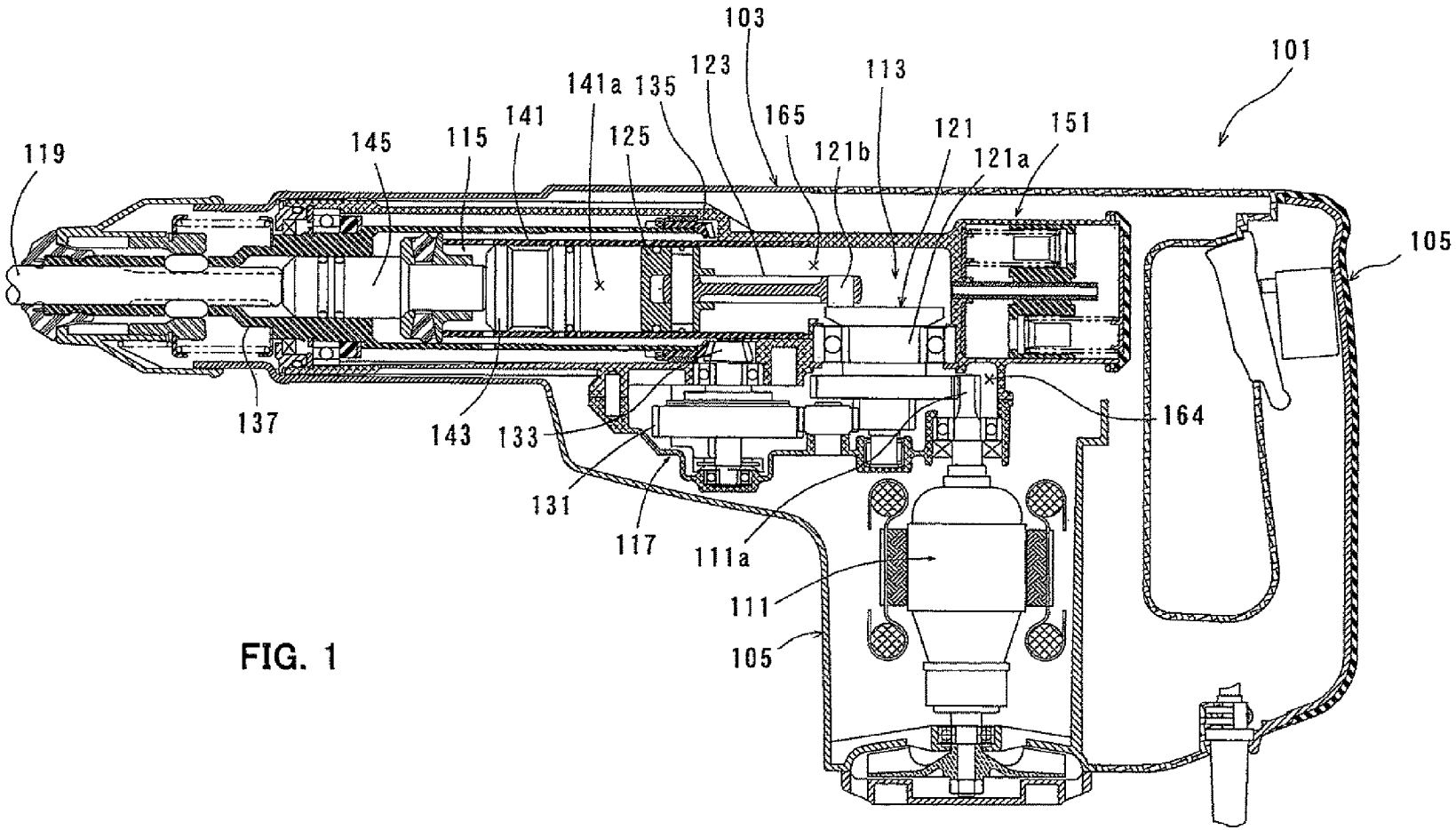
FIG. 1 is a sectional side view showing an entire structure of a hammer drill 101 according to this embodiment.
Figure 2:
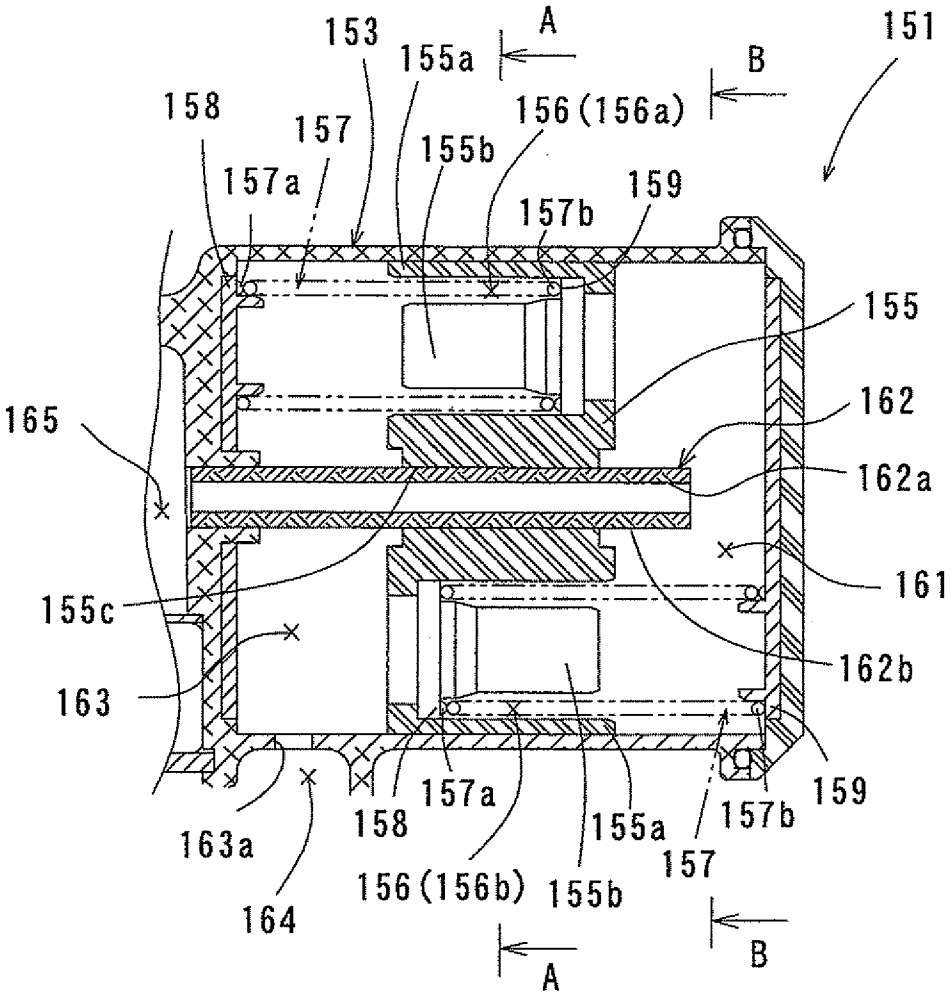
FIG. 2 is a partially enlarged view showing a dynamic vibration reducer 151 in FIG. 1.
Figure 3:
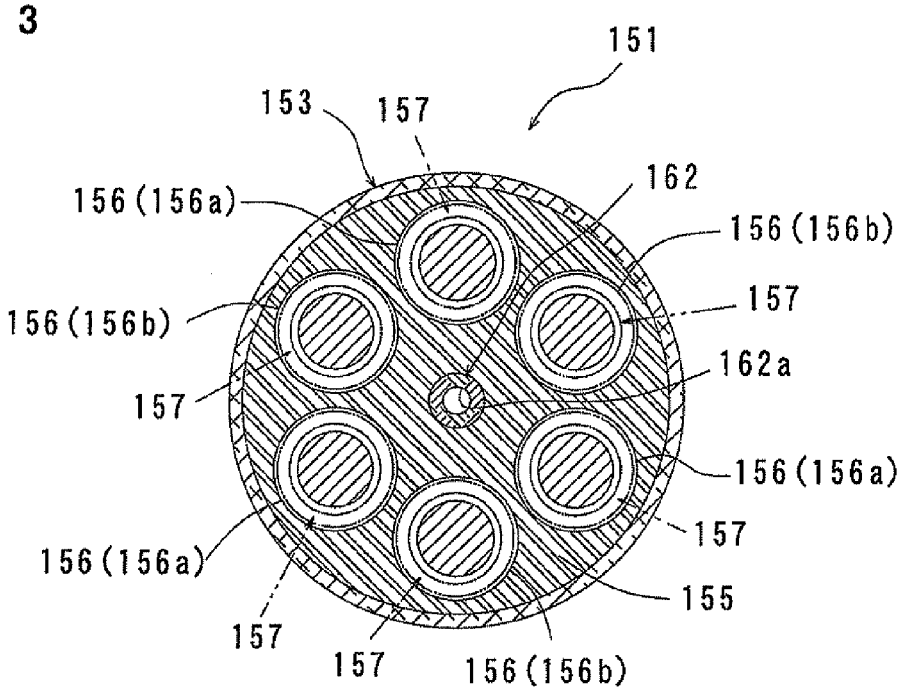
FIG. 3 is a sectional view of the dynamic vibration reducer 151 taken along line A-A in FIG. 2.
Figure 4:
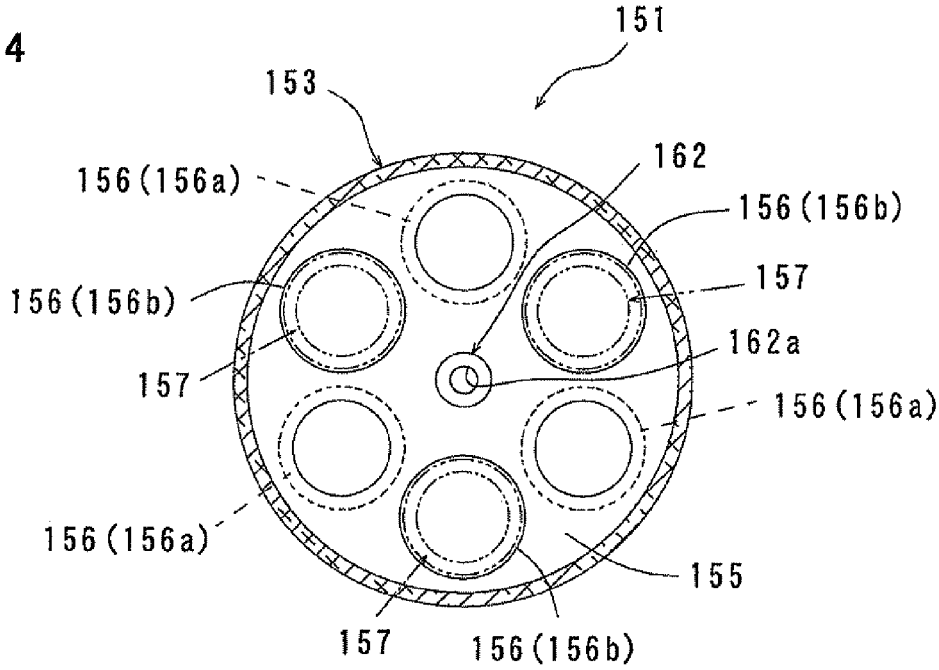
FIG. 4 is a sectional view of the dynamic vibration reducer 151 taken along line B-B in FIG. 2.

An embodiment of the "power tool" according to the invention is now described with reference to FIGS. 1 to 4. In this embodiment, an electric hammer drill is explained as a representative embodiment of the power tool. FIG. 1 is a sectional side view showing an entire structure of a hammer drill 101 according to this embodiment. FIG. 2 is a partially enlarged view showing a dynamic vibration reducer 151 in FIG. 1. FIG. 3 is a sectional view of the dynamic vibration reducer 151 taken along line A-A in FIG. 2, and FIG. 4 is a sectional view of the dynamic vibration reducer 151 taken along line B-B in FIG. 2.

As shown in FIG. 1, the electric hammer drill 101 of this embodiment mainly includes a body 103 that forms an outer shell of the hammer drill 101, a tool holder 137 connected to a front end region (left end as viewed in FIG. 1) of the body 103 in the longitudinal direction of the body 103, a hammer bit 119 detachably coupled to the tool holder 137, and a handgrip 105 designed to be held by a user and connected to the other end (right end as viewed in FIG. 1) of the body 103 in the longitudinal direction or particularly to the body 103 in a tool rear region rearward of a driving motor 111 which is described below. The hammer bit 119 is held by the tool holder 137 such that it is allowed to reciprocate with respect to the tool holder in its axial direction (in the longitudinal direction of the body 103) and prevented from rotating with respect to the tool holder in its circumferential direction. The body 103, the hammer bit 119 and the handgrip 105 are features that correspond to the "tool body", the "tool bit" and the "handle", respectively, according to the invention. In this embodiment, for the sake of convenience of explanation, the side of the hammer bit 119 is taken as the front or tool front region and the side of the handgrip 105 as the rear or tool rear region.

The body 103 is configured as a housing that houses a driving motor 111, a motion converting mechanism 113, a striking mechanism 115, a power transmitting mechanism 117 and a dynamic vibration reducer 151. The body 103 may be formed by a combination of different housings each of which houses one or more of the above-described elements to be housed. In this embodiment, the motion converting mechanism 113 appropriately converts a rotating output of the driving motor 111 into linear motion and then transmits it to the striking mechanism 115. Then, an impact force is generated in the axial direction of the hammer bit 119 via the striking mechanism 115. Therefore, this hammer drill 101 having the striking mechanism 115 is also referred to as an impact tool. Further, the power transmitting mechanism 117 appropriately reduces the speed of the rotating output of the driving motor 111 and transmits it to the hammer bit 119 as a rotating force, so that the hammer bit 119 is caused to rotate in the circumferential direction. The driving motor 111 here is a feature that corresponds to the "driving motor" according to this invention.

The motion converting mechanism 131 serves to convert rotation of a motor shaft 111*a* of the driving motor 111 into linear motion and transmit it to the striking mechanism 115. The motion converting mechanism 131 is formed by a crank mechanism which includes a crank shaft 121, a crank arm 123 and a piston 125 and is driven by gear engagement with the motor shaft 111*a* of the driving motor 111. The crank shaft 121 has a crank shaft part 121*a* and an eccentric pin 121*b* eccentrically disposed on the crank shaft part 121*a*. One end of the crank arm 123 is connected to the eccentric pin 121*b* of the crank shaft 121, and the other end is connected to the piston 125. The piston 125 forms a driving element for driving the striking mechanism 115 and can slide within a cylinder 141 in the axial direction of the hammer bit 119. In this embodiment, the motion converting mechanism 131 is disposed in the tool front region forward of the driving motor 111 in the axial direction of the hammer bit 119. More specifically, the crank shaft part 121*a* and the eccentric pin 121*b* of the crank shaft 121 in the motion converting mechanism 131 are disposed in the tool front region forward of the motor shaft 111*a* of the driving motor 111 in the axial direction of the hammer bit 119. The motion converting mechanism 131 here is a feature that corresponds to the "motion converting mechanism" according to this invention.

The striking mechanism 115 mainly includes a striking element in the form of a striker 143 slidably disposed within the bore of the cylinder 141, and an intermediate element in the form of an impact bolt 145 that is slidably disposed within the tool holder 137 and serves to transmit the kinetic energy of the striker 143 to the hammer bit 119. The striking mechanism 115 here is a feature that corresponds to the "striking mechanism" according to this invention. A closed air chamber 141*a* is formed between the piston 125 and the striker 143 in the cylinder 141. The striker 143 is driven on the principle of a so-called "air spring" by utilizing air within the air chamber 141*a* of the cylinder 141 as a result of sliding movement of the piston 125. The striker 143 then collides with (strikes) the intermediate element in the form of the impact bolt 145 which is slidably disposed in the tool holder 137, and transmits a striking force to the hammer bit 119 via the impact bolt 145.

A crank chamber 165 for housing the crank shaft 121 and the crank arm 123 is provided on the opposite side (the tool rear side) of the piston 125 from the air chamber 141*a* and designed as a space which causes air pressure fluctuations in opposite phase with respect to air pressure fluctuations of the air chamber 141*a*. Specifically, when the striking mechanism 115 strikes the hammer bit 119, the air chamber 141*a* relatively increases in pressure, while the crank chamber 165 relatively decreases in pressure. On the other hand, when the striking movement is completed, the air chamber 141*a* relatively decreases in pressure, while the crank chamber 165 relatively increases in pressure. Thus, the patterns of air pressure fluctuations are generally reversed between the air chamber 141*a* and the crank chamber 165. Here, the air chamber 141*a* and the crank chamber 165 are features that correspond to the "first space" and the "second space", respectively, according to this invention.

The tool holder 137 is rotatable and caused to rotate when the power transmitting mechanism 117 transmits rotation of the driving motor 111 to the tool holder 137 at a reduced speed. The power transmitting mechanism 117 includes an intermediate gear 131 that is rotationally driven by the driving motor 111, a small bevel gear 133 that rotates together with the intermediate gear 131, and a large bevel gear 135 that engages with the small bevel gear 133 and rotates around a longitudinal axis of the body 103. The power transmitting mechanism 117 transmits rotation of the driving motor 111 to the tool holder 137 and further to the hammer bit 119 held by the tool holder 137. The hammer drill 101 can be appropriately switched between a hammer mode in which an operation is performed on a workpiece by applying only a striking force in the axial direction to the hammer bit 119 and a hammer drill mode in which an operation is performed on a workpiece by applying both the striking force in the axial direction and the rotating force in the circumferential direction to the hammer bit 119. This construction is not directly related to the invention and thus will not be described.

During operation of the hammer drill 101 (when the hammer bit 119 is driven), impulsive and cyclic vibration is caused in the body 103 in the axial direction of the hammer bit 119. Main vibration of the body 103 which is to be reduced is a compressing reaction force which is produced when the piston 125 and the striker 143 compress air within the air chamber 141*a*, and a striking reaction force which is produced with a slight time lag behind the compressing reaction force when the striker 143 strikes the hammer bit 119 via the impact volt 145.

The hammer drill 101 has a dynamic vibration reducer 151 in order to reduce the above-described vibration caused in the body 103. As shown in FIG. 2, the dynamic vibration reducer 151 mainly includes a dynamic vibration reducer body 153, a vibration reducing weight 155 and front and rear coil springs 157 disposed at the front and rear of the weight 155 and extending in the axial direction of the hammer bit 119.

The dynamic vibration reducer body 153 has a hollow or cylindrical housing space and is provided as a cylindrical guide for guiding the weight 155 to slide with stability. The dynamic vibration reducer body 153 here is a feature that corresponds to the "dynamic vibration reducer body" according to this invention.

As described above, in the above-mentioned construction in which the motion converting mechanism 113 is disposed in the tool front region forward of the driving motor 111 in the axial direction of the hammer bit 119, a free space is likely to be formed in an intermediate region between the motion converting mechanism 113 and the handgrip 105. Specifically, the intermediate region is defined as a region between a crank shaft part 121*a* and an eccentric pin 121*b* of the crank shaft 121 and the handgrip 105, and as a tool upper region (upper region as viewed in FIG. 1) above a motor shaft 111*a* of the driving motor 111. In this embodiment, the dynamic vibration reducer body 153 is disposed in the intermediate region between the motion converting mechanism 113 and the handgrip 105. Thus, it is not necessary to provide an additional installation space for installing the dynamic vibration reducer body 153, so that the space within the body 103 can be effectively utilized. Therefore, rational arrangement of the dynamic vibration reducer 151 can be realized. Further, preferably, the intermediate region between the motion converting mechanism 113 and the handgrip 105 is provided closer to the axis of the hammer bit 119, or on an extension of the axis of the hammer bit 119. With this construction, vibration caused by driving the hammer bit 119 can be efficiently reduced, so that the dynamic vibration reducer having a higher vibration reducing effect or higher vibration reducing performance can be realized.

The weight 155 is configured as a mass part which is slidably disposed within the housing space of the dynamic vibration reducer body 153 so as to move within the housing space of the dynamic vibration reducer 153 in the longitudinal direction (the axial direction of the hammer bit 119). Specifically, the weight 155 is configured as a weight member having a circular section in a direction transverse to the axial direction of the hammer bit 119. The weight 155 here is a feature that corresponds to the "weight" and the "weight member" according to this invention.

The coil springs 157 are configured as elastic elements which support the weight 155 in such a manner as to apply respective spring forces to the weight 155 toward each other when the weight 155 moves within the housing space of the dynamic vibration reducer body 153 in the longitudinal direction (in the axial direction of the hammer bit 119). Further, the coil spring 157 here is a feature that corresponds to the "coil spring" according to this invention.

The dynamic vibration reducer 151 having the above-described construction which is housed within the body 103 is provided such that the weight 155 and the coil springs 157 serve as vibration reducing elements in the dynamic vibration reducer 151 and cooperate to passively reduce vibration of the body 103 during operation of the hammer drill 101. Thus, the above-described vibration caused in the body 103 of the hammer drill 101 is reduced, so that vibration of the body 103 can be alleviated or reduced during operation.

Further, the weight 155 constructed as described above has spring receiving spaces 156 having an annular section and extending in the form of a hollow in the axial direction of the hammer bit 119 over a predetermined region in the front and rear regions of the weight 155 in the axial direction of the hammer bit 119. One end of each of the coil springs 157 is received in the associated spring receiving space 156. The spring receiving space 156 here is a feature that corresponds to the "spring receiving part" according to this invention. Each of the annular spring receiving spaces 156 is an elongate space extending in the axial direction of the hammer bit 119 and configured as a space (groove) which is hollowed through and enclosed by an outer cylindrical portion 155*a* and a columnar portion 155*b* inside the cylindrical portion 155*a*. The cylindrical portion 155*a* and the columnar portion 155*b* may be separately formed, or they may be formed in one piece.

In this embodiment, as shown in FIGS. 3 and 4, a total of six spring receiving spaces 156 are arranged in the same plane in a direction transverse to the axial direction of the hammer bit 119. Particularly, as shown in FIG. 4, the six spring receiving spaces 156 include three first spring receiving spaces 156*a* formed in the front region (left region as viewed in FIG. 2) of the weight 155 and three second spring receiving spaces 156*b* formed in the rear region (right region as viewed in FIG. 2) of the weight 155, and the first spring receiving spaces 156*a* and the second spring receiving spaces 156*b* are alternately arranged and evenly spaced in the circumferential direction. Each of the coil springs 157 is received within the associated spring receiving space 156 and in this state, a spring front end 157*a* is fixed to an associated spring front end fixing part 158 and a spring rear end 157*b* is fixed to an associated spring rear end fixing part 159. Here, the first spring receiving space 156*a* and the second spring receiving space 156*b* are features that correspond to the "front surface region spring receiving part" and the "rear surface region spring receiving part", respectively, according to this invention. Thus, in this embodiment, a plurality of spring receiving parts 156 are arranged in front and rear surface regions of the weight 155 in a balanced manner, so that the center of gravity of the weight 155 can be easily put in balance. Further, with such an arrangement of the coil springs in the front and rear surface regions of the weight 155 in a balanced manner, spring forces of the coil springs can be exerted on front and rear surfaces of the weight 155 in a balanced manner.

As for the front coil spring 157 received in the first spring receiving space 156*a*, a front wall part of the dynamic vibration reducer body 153 is used as the spring front end fixing part 158 to which the spring front end 157*a* is fixed, and the bottom (end) of the first spring receiving space 156*a* is used as the spring rear end fixing part 159 to which the spring rear end 157*b* is fixed. As for the rear coil spring 157 received in the second spring receiving space 156*b*, the bottom (end) of the second spring receiving space 156*b* is used as the spring front end fixing part 158 to which the spring front end 157*a* is fixed, and a rear wall part of the dynamic vibration reducer body 153 is used as the spring rear end fixing part 159 to which the spring rear end 157*b* is fixed. With this construction, the front and rear coil springs 157 apply respective elastic biasing forces to the weight 155 toward each other in the axial direction of the hammer bit 119. Specifically, the weight 155 can move in the axial direction of the hammer bit 119 under the respective biasing forces of the front and rear coil springs 157 acting toward each other. Further, each of the first and second spring receiving spaces 156*a*, 156*b* has a width larger than the wire diameter of the coil spring 157. Thus, preferably, the coil spring 157 is loosely fitted in the spring receiving space 156 such that the coil spring 157 is kept from contact with the inner surface of the cylindrical portion 155*a* and the outer surface of the columnar portion 155*b*.

As described above, in the dynamic vibration reducer 151 according to this embodiment, the spring receiving spaces 156 are formed inside the weight 155 and one end of each of the coil springs 157 is disposed within the spring receiving space 156. Therefore, the length of the dynamic vibration reducer 151 in the axial direction of the hammer bit 119 with the coil spring 157 received and mounted in the spring receiving space 156 of the weight 155 can be reduced, so that the dynamic vibration reducer 151 can be reduced in size in the axial direction of the hammer bit 119. Further, in the dynamic vibration reducer 151 according to this embodiment, the cylindrical portion 155*a* having a mass with a higher density than the coil spring 157 is disposed on the outer peripheral side of the coil spring 157. Therefore, compared with the known structure in which a coil spring having a lower density than a weight is disposed on the outer peripheral side of the weight, the mass of a vibration reducing element in the form of the weight 155 can be increased, so that the space utilization efficiency is enhanced. As a result, the vibration reducing power of the dynamic vibration reducer 151 can be increased. Further, with the construction in which the cylindrical portion 155*a* of the weight 155 is disposed on the outer peripheral side of the coil spring 157, the contact length of the weight 155 in the direction of movement or the axial length of the sliding surface of the weight 155 in contact with the wall surface of the dynamic vibration reducer body 153 can be increased. Thus, stable movement of the weight 155 can be easily secured.

In this embodiment, as shown in FIG. 2, particularly, the first and second spring receiving spaces 156*a*, 156*b* of the spring receiving space 156 formed in the weight 155 are arranged to overlap each other. Accordingly, the coil springs 157 received within the first spring receiving spaces 156*a* and the coil springs 157 received within the second spring receiving spaces 156*b* are arranged to overlap each other in a direction transverse to the extending direction of the coil springs. With such a construction, the length of the weight 155 in the axial direction with the coil springs mounted in the spring receiving spaces 156 (156*a*, 156*b*) can be further reduced. Therefore, this construction is effective in further reducing the size of the dynamic vibration reducer 151 in the axial direction and in reducing its weight with a simpler structure. Thus, this construction is particularly effective when installation space for installing the dynamic vibration reducer 151 within the body 103 is limited in the longitudinal direction of the body 103. Further, the coil springs can be further upsized by the amount of the overlap between the coil springs 157 received within the first spring receiving spaces 156*a* and the coil springs 157 received within the second spring receiving spaces 156*b*, provided that the length of the dynamic vibration reducer in the longitudinal direction is unchanged. In this case, the dynamic vibration reducer can provide a higher vibration reducing effect with stability by the upsized coil springs.

As described above, according to this embodiment, the vibration reducing power of the dynamic vibration reducer 151 can be increased and furthermore the dynamic vibration reducer 151 can be reduced in size, so that vibration reducing effect of the dynamic vibration reducer 151 can be enhanced without upsizing the body 103 of the hammer drill 101 and with a minimum of weight increase.

Further, as shown in FIG. 2, in this embodiment, the dynamic vibration reducer 151 has a first actuation chamber 161 and a second actuation chamber 163 within the dynamic vibration reducer body 153. The first and second actuation chambers 161, 163 are configured as spaces separated from each other within the dynamic vibration reducer body 153 by the weight 155 and formed at the front and rear of the weight 155 in the axial direction of the hammer bit 119.

The first actuation chamber 161 is designed as a space at the rear (on the left side as viewed in FIG. 2) of the weight 155. The first actuation chamber 161 normally communicates with a hermetic crank chamber 165 which is in noncommunication with the outside, via a first communication hole 162*a* of a communication pipe 162. On the other hand, the second actuation chamber 163 communicates with a gear chamber 164 in which a motor shaft 111*a* of the driving motor 111 is disposed, via a second communication hole 163*a* formed through an outer peripheral wall of the dynamic vibration reducer body 153. Here, the first actuation chamber 161 and the second actuation chamber 163 are features that correspond to the "rear chamber" and the "front chamber", respectively, according to the invention.

Pressure within the crank chamber 165 fluctuates when the motion converting mechanism 113 is driven. This is caused by change of the capacity of the crank chamber 165 when the piston 125 of the motion converting mechanism 113 reciprocates within the cylinder 141. In this embodiment, the weight 155 of the dynamic vibration reducer 151 is actively driven by introducing air from the crank chamber 165 into the first actuation chamber 161 by pressure fluctuations of the crank chamber 165. In this manner, the dynamic vibration reducer 151 is caused to perform a vibration reducing function. Specifically, in this embodiment, as shown in FIG. 2, a communication pipe 162 having a first communication hole 162*a* is provided in the dynamic vibration reducer body 153. With this construction, the dynamic vibration reducer 151 not only has the above-mentioned passive vibration reducing function but also serves as an active vibration reducing mechanism by forced vibration in which the weight 155 is actively driven. Thus, vibration caused in the body 103 during hammering operation can be further effectively reduced. The communication pipe 162 is particularly designed as a piping member extending linearly in the axial direction of the hammer bit 119. The communication pipe 162 is installed to extend from the crank chamber 165 disposed in the tool front region forward of the dynamic vibration reducer body 153, into the first actuation chamber 161 through the second actuation chamber 163 and then the weight 155. With such a construction, the communication pipe 162 is installed in such a manner as to provide communication between the crank chamber 165 and the first actuation chamber 161 in the shortest distance.

Further, the above-described communication pipe 162 linearly extends in the axial direction of the hammer bit 119 and passes through the center of a circular section of the weight 155. In such a construction, an outer surface 162*b* of the communication pipe 162 and an inner surface 155*c* of the weight 155 fitted onto the communication pipe 162 are held in sliding contact with each other, so that the communication pipe 162 serves as a guide member for guiding linear movement of the weight 155 in the axial direction. This construction is rational in that linear movement of the weight 155 in the axial direction can be made smoother and the communication pipe 162 can be further provided with a function as a guide member for guiding linear movement of the weight 155 in the axial direction in addition to the function of introducing air from the crank chamber 165 into the first actuation chamber 161 of the dynamic vibration reducer 151.

Further, when air flows between the crank chamber 165 and the first actuation chamber 161 via the first communication hole 162*a* of the communication pipe 162, the capacity of the second actuation chamber 163 which communicates with the gear chamber 164 varies with pressure of the first actuation chamber 161. Specifically, when the pressure of the first actuation chamber 161 increases relative to that of the second actuation chamber 163, air within the second actuation chamber 163 escapes into the gear chamber 164 and thus the capacity of the second actuation chamber 163 decreases. On the other hand, when the pressure of the first actuation chamber 161 decreases relative to that of the second actuation chamber 163, air within the gear chamber 164 escapes into the second actuation chamber 163 and thus the capacity of the second actuation chamber 163 increases. As a result, forced vibration in which the weight 155 is actively driven is smoothly performed without being interfered by air of the second actuation chamber 163.

In the above-mentioned embodiment, the front and rear regions of the weight 155 are hollowed to form the spring receiving spaces 156 for receiving one end of the coil spring 157. In this invention, however, it may be constructed, without providing the spring receiving spaces 156 in the weight 155, such that one end of each of the coil springs 157 is fixed on the front or rear end of the weight 155. In this case, the spring receiving spaces 156 or fixing locations of the coil springs 157 may be provided on at least one of the front and rear ends of the weight 155, as necessary.

In the above-mentioned embodiment, the three first spring receiving spaces 156*a* formed in the front region of the weight 155 and the three second spring receiving spaces 156*b* formed in the rear region of the weight 155 are alternately arranged and evenly spaced in the circumferential direction of the weight 155. In this invention, however, the arrangement of the first spring receiving space 156*a* in the front region of the weight 155 and the arrangement of the second spring receiving space 156*b* in the rear region of the weight 155 can be appropriately changed as necessary.

In the above-mentioned embodiment, the communication pipe 162 which provides communication between the crank chamber 165 and the first actuation chamber 161 of the dynamic vibration reducer 151 is configured and installed to extend from the crank chamber 165 into the first actuation chamber 161 through the second actuation chamber 163 and then the weight 155. In this invention, however, the communication pipe 162 may have any other configuration. For example, a member corresponding to the communication pipe 162 may be provided and configured to extend from the crank chamber 165 into the first actuation chamber 161 via the outside of the dynamic vibration reducer body 153 of the dynamic vibration reducer 151. Further, in the above-mentioned embodiment, the communication pipe 162 also serves as the guide member for guiding linear movement of the weight 155 in the axial direction, but in this invention, a member other than a member corresponding to the communication pipe 162 may serve to guide the weight 155.

In the above-mentioned embodiment, the hammer drill 101 is explained as a representative example of the power tool, but this invention can also be applied to various kinds of power tools which perform an operation on a workpiece by linear movement of a tool bit. For example, this invention can be suitably applied to power tools, such as a jigsaw or a reciprocating saw, which perform a cutting operation on a workpiece by reciprocating a saw blade.

DESCRIPTION OF NUMERALS

101 hammer drill (power tool)
103 body (tool body)
105 handgrip
111 driving motor
111*a* motor shaft
113 motion converting mechanism
115 striking mechanism
117 power transmitting mechanism
119 hammer bit (tool bit)
121 crank shaft
121*a* crank shaft part
121*b* eccentric pin
123 crank arm
125 piston
131 intermediate gear
133 small bevel gear
135 large bevel gear
137 tool holder
141 cylinder
141*a* air chamber
143 striker
145 impact bolt
151 dynamic vibration reducer
153 dynamic vibration reducer body
155 weight
155*a* cylindrical portion
155*b* columnar portion
155*c* inner surface
156 spring receiving space (spring receiving part)
156*a* first spring receiving space (front surface region spring receiving part)
156*b* second spring receiving space (rear surface region spring receiving part)
157 coil spring
157*a* spring front end
157*b* spring rear end
158 spring front end fixing part
159 spring rear end fixing part
161 first actuation chamber
162 communication pipe
162*a* first communication hole
162*b* outer surface
163 second actuation chamber
163*a* second communication hole
164 gear chamber
165 crank chamber

The invention claimed is:

1. A power tool which linearly drives a tool bit to perform a predetermined operation on a workpiece comprising:

a tool body, a driving motor, a motion converting mechanism and a dynamic vibration reducer which are housed in the tool body and a handle held by a user, the handle connected to the tool body in a tool rear region rearward of the driving motor, wherein:

the motion converting mechanism is disposed in a tool front region forward of the driving motor in an axial direction of the tool bit and converts rotation of the driving motor into linear motion and transmits it to the tool bit, the dynamic vibration reducer includes a dynamic vibration reducer body disposed in an intermediate region between the motion converting mechanism and the handle, the dynamic vibration reduce having a housing space, a weight disposed within the housing space of the dynamic vibration reducer body in such a manner as to be linearly movable in the axial direction of the tool bit, and a coil spring that extends between at least one of front and rear surfaces of the weight and the dynamic vibration reducer body in the axial direction of the tool bit to elastically support the weight in the axial direction, wherein the dynamic vibration reducer reduces vibration of the tool body during operation by linear movement of the weight elastically supported by the coil spring in the axial direction of the tool bit.

2. The power tool according to claim 1, wherein the weight has a spring receiving part extending in a hollow form in the axial direction of the tool bit in at least one of front and rear surface regions of the weight, and the spring receiving part receives one end of the coil spring which elastically supports the weight.

3. The power tool according to claim 2, wherein:

the spring receiving part comprises a front surface region spring receiving part and a rear surface region spring receiving part which extend in a form of a hollow in the axial direction of the tool bit in the front and rear surface regions of the weight, the front surface region spring receiving part receives one end of the coil spring that elastically supports the weight from a front of the weight, while the rear surface region spring receiving part receives one end of the coil spring that elastically supports the weight from a rear of the weight, and the front and rear surface region spring receiving parts are arranged to overlap each other in its entirety or in part in a direction transverse to an extending direction of the spring receiving parts.

4. The power tool according to claim 3, wherein:

the motion converting mechanism includes a closed first space, a striking mechanism which strikes the tool bit by utilizing air pressure fluctuations within the first space, and a second space which is provided in a different region from the first space and causes air pressure fluctuations in opposite phase with respect to air pressure fluctuations of the first space, and the dynamic vibration reducer has front and rear chambers and a communication path which provides communication between the rear chamber and the second space, the front and rear chambers being separated from each other by the weight within the dynamic vibration reducer body and formed at the front and rear of the weight in the axial direction of the tool bit.

5. The power tool according to claim 2, wherein:

the motion converting mechanism includes a closed first space, a striking mechanism which strikes the tool bit by utilizing air pressure fluctuations within the first space, and a second space which is provided in a different region from the first space and causes air pressure fluctuations in opposite phase with respect to air pressure fluctuations of the first space, and the dynamic vibration reducer has front and rear chambers and a communication path which provides communication between the rear chamber and the second space, the front and rear chambers being separated from each other by the weight within the dynamic vibration reducer body and formed at the front and rear of the weight in the axial direction of the tool bit.

6. The power tool according to claim 1, wherein:

the weight has a spring receiving part comprising a front surface region spring receiving part and a rear surface region spring receiving part which extend in a form of a hollow in the axial direction of the tool bit in the front and rear surface regions of the weight, the front surface region spring receiving part receives one end of the coil spring that elastically supports the weight from a front of the weight, while the rear surface region spring receiving part receives one end of the coil spring that elastically supports the weight from a rear of the weight, and the front and rear surface region spring receiving parts are arranged to overlap each other in its entirety or in part in a direction transverse to an extending direction of the spring receiving parts.

7. The power tool according to claim 6, wherein the weight is configured as a weight member having a circular section in a direction transverse to the axial direction of the tool bit, and a plurality of the front surface region spring receiving parts are provided in the front surface region of the weight member and evenly spaced in the circumferential direction of the weight member, while a plurality of the rear surface region spring receiving parts are provided in the rear surface region of the weight member and evenly spaced in the circumferential direction of the weight member.

8. The power tool according to claim 7, wherein:

the motion converting mechanism includes a closed first space, a striking mechanism which strikes the tool bit by utilizing air pressure fluctuations within the first space, and a second space which is provided in a different region from the first space and causes air pressure fluctuations in opposite phase with respect to air pressure fluctuations of the first space, and the dynamic vibration reducer has front and rear chambers and a communication path which provides communication between the rear chamber and the second space, the front and rear chambers being separated from each other by the weight within the dynamic vibration reducer body and formed at the front and rear of the weight in the axial direction of the tool bit.

9. The power tool according to claim 6, wherein:

the motion converting mechanism includes a closed first space, a striking mechanism which strikes the tool bit by utilizing air pressure fluctuations within the first space, and a second space which is provided in a different region from the first space and causes air pressure fluctuations in opposite phase with respect to air pressure fluctuations of the first space, and the dynamic vibration reducer has front and rear chambers and a communication path which provides communication between the rear chamber and the second space, the front and rear chambers being separated from each other by the weight within the dynamic vibration reducer body and formed at the front and rear of the weight in the axial direction of the tool bit.

10. The power tool according to claim 1, wherein:

the motion converting mechanism includes a closed first space, a striking mechanism which strikes the tool bit by utilizing air pressure fluctuations within the first space, and a second space which is provided in a different region from the first space and causes air pressure fluctuations in opposite phase with respect to air pressure fluctuations of the first space, and the dynamic vibration reducer has front and rear chambers and a communication path which provides communication between the rear chamber and the second space, the front and rear chambers being separated from each other by the weight within the dynamic vibration reducer body and formed at the front and rear of the weight in the axial direction of the tool bit.

11. The power tool according to claim 10, wherein the second space is disposed in the tool front region forward of the dynamic vibration reducer body in the axial direction of the tool bit, and the communication path comprises a communication pipe which is installed to extend from the second space into the rear chamber through the front chamber and then the weight.

12. The power tool according to claim 11, wherein the communication pipe linearly extends in the axial direction of the tool bit and an outer surface of the communication pipe and an inner surface of the weight fitted onto the communication pipe are held in sliding contact with each other, so that the communication pipe serves as a guide member for guiding linear movement of the weight in the axial direction.

* * * * *